United States Patent [19]

Tolf et al.

[11] Patent Number: 5,010,920

[45] Date of Patent: Apr. 30, 1991

[54] DEVICE FOR EMPTYING WATER FROM A DISHWASHER

[75] Inventors: Anders K. H. Tolf; Keijo A. Stridh, both of Jönköping, Sweden

[73] Assignee: Aktiebolaget Electrolux, Stockholm, Sweden

[21] Appl. No.: 502,067

[22] Filed: Mar. 29, 1990

[30] Foreign Application Priority Data

Apr. 5, 1989 [SE] Sweden ..... 8901194

[51] Int. Cl.[5] ..... F16K 24/00

[52] U.S. Cl. ..... 137/565; 137/587; 134/57 D

[58] Field of Search ..... 137/565, 587; 134/57 D; 417/363

[56] References Cited

U.S. PATENT DOCUMENTS

| | | | |
|---|---|---|---|
| 2,353,368 | 7/1944 | Schulz | 134/57 D |
| 2,893,408 | 7/1959 | Walker | 134/57 D |
| 2,962,048 | 11/1960 | Steidley | 137/387 |
| 3,490,486 | 1/1970 | Cushing | 137/387 |
| 3,832,870 | 9/1974 | Todd-Reeve | 134/57 D |
| 3,885,580 | 5/1975 | Cushing | 137/387 |
| 4,741,357 | 5/1988 | Battel et al. | 137/387 |

FOREIGN PATENT DOCUMENTS

| | | |
|---|---|---|
| 2428941 | 1/1976 | Fed. Rep. of Germany . |
| 2744967 | 4/1979 | Fed. Rep. of Germany . |
| 2425228 | 12/1979 | France . |

*Primary Examiner*—A. Michael Chambers

*Attorney, Agent, or Firm*—Pearne, Gordon, McCoy & Granger

[57] ABSTRACT

A device for a dishwasher comprising a tub with a bottom (10) which is provided with a sump (11) for collecting liquid circulating in the tub. When the machine is emptied, the liquid is distributed from the sump to the inlet side of a sewage pump (20) from which the liquid is discharged to a sewer or the like. In order to make the overall height of the machine small, to limit the quantity of watr remaining in the sump, and to considerably decrease the working time of the sewage pump necessary to achieve this small quantity, the bottom surface of the sump (11) is placed below or on the same level as the pump housing (23), and the inlet (21) of the pump communicates with the sump via a pipe (17) which has a restriction (26).

16 Claims, 2 Drawing Sheets

DEVICE FOR EMPTYING WATER FROM A DISHWASHER

BACKGROUND OF THE INVENTION

The present invention relates in general to dishwashers, and more particularly to means to facilitate emptying of water from a dishwasher.

DESCRIPTION OF RELATED ART

Dishwashers are known in the art which are designed so that the liquid, usually water, flows by means of gravity via a hose from the sump to the sewage pump, the sewage pump being placed below the bottom of the dishwasher tub. This is usually a reliable method to minimize the quantity of water remaining in the tub. Minimizing the quantity of water remaining in the tub is desirable, since any remaining water will pollute the fresh water which is taken in during the following dishwashing cycle. The above arrangement is used for dishwashers which are placed on the floor as well as on the bench or counter.

However, the above arrangement has a drawback, in particular with regard to machines which are placed on a bench or counter where it is important to restrict the overall dimensions of the machine as much as possible for a given size of tub. The drawback is that the overall height of the machine arranged as described above becomes much larger than the height of the tub because of the location of the pump.

German Patent DE 2,428,941 shows a dishwasher having a pump placed outside and above the bottom of the tub. According to this arrangement, the inlet side of the pump is connected to the tub by means of a conduit which has a check valve preventing the water in the outlet hose and in the pump from flowing back into the tub. Such an arrangement is not reliable, however. since there is a risk that food particles, etc. in the water flow get stuck on the valve seat, thereby preventing the valve body from closing. Moreover, since the outlet of the tub has a comparatively large diameter, air will be sucked into the pump before the water level sinks to the bottom surface.

It is also known to place a circulation pump in a dishwasher beside the sump (see French Patent FR 2,425,228) and to connect the pump with the sump by a knee-shaped pipe. In order to use a small quantity of water during the washing procedure, the inlet opening of the pipe is placed close to the bottom of the sump and the bottom is shaped so that the flow into the pipe is facilitated. However, no measures have been taken to safeguard that the water from the inlet side of the pipe is distributed into the pump.

SUMMARY OF THE INVENTION

In accordance with the present invention, a device for a dishwasher comprising a tub with a bottom which is provided with a sump for collecting liquid is disclosed. The liquid, during emptying of the dishwasher. is distributed from the sump to the inlet side of a sewage pump from which the liquid is discharged to a sewer. The bottom surface of the sump is disposed no higher than the level of the pump housing of the sewage pump. The inlet of the sewage pump communicates via a pipe with the sump. The pipe has a restriction. The pipe comprises an outer part, mainly vertical, and an inner part, mainly horizontal. The restriction is a wall extending mainly vertically upwards from the inner part.

The purpose of this invention is to create an arrangement where the height of the dishwasher is limited, where the quantity of water remaining in the tub after emptying the machine is as small as possible, and where the working time of the pump for creating this small quantity is considerably reduced.

A preferred embodiment of the present invention is described in the following specification with reference to the accompanying drawings.

DESCRIPTION OF THE PREFERRED EMBODIMENT

Figure 1:
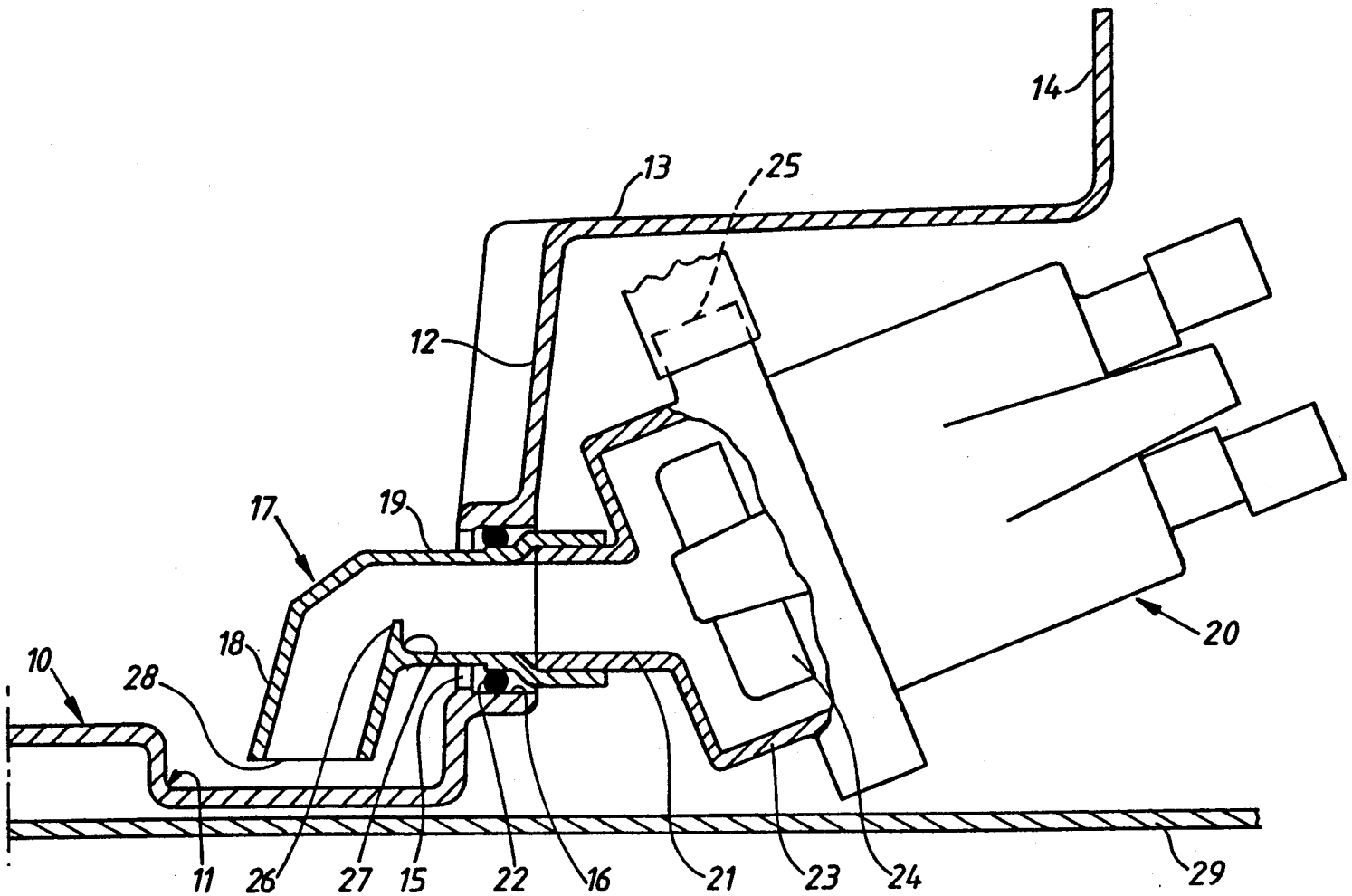
FIG. 1 is a vertical section of the lower part of the dishwasher tub with the sewage pump.

With reference to FIG. 1, the bottom 10 of the dishwasher tub is provided with a sump 11 in which the water circulating in the machine is collected. From the sump 11, an edge part 12 extends vertically upwards and continues via a mainly flat surface 13 into the wall 14 of the tub. The edge part 12 has a hole 15 which forms a cylinder-shaped sealing surface 16. Through the hole 15 a pipe 17 is inserted. The pipe 17 has an outer mainly vertical part 18 and an inner mainly horizontal part 19. The end of the inner part 19 has a collar so that a socket for the inlet to the sewage pump 20 is formed. The inlet of the sewage pump 20 is shaped as a sleeve 21 which is inserted in the collar end of the pipe 17. Between the pipe 17 and the sealing surface 16 there is an O-ring 22 by means of which the tub is sealed from the surroundings. The inlet sleeve 21 of the pump 20 continues into a pump housing 23 in which an impeller 24 rotates in the usual way and distributes the water to an outlet 25 from which, by means of a hose, it is distributed to a sewer.

The pipe 17, which preferably is made of plastic, has a restriction comprising a wall part 26 extending vertically upwards from the location 27, where the vertical outer part 18 continues into the horizontal inner part 19. Preferably, the restriction area of the wall part 26 is somewhat less than half the area of the inner pipe section. The inlet 28 of the pipe connection 17 is placed a short distance, preferably 3—8 mm, from the bottom of the sump 11. This means that the lower part of the pump housing 23 is placed at mainly the same height as the inlet 28 of the pipe connection 17.

The outer shell of the dishwasher is shown in FIG. 1 at 29, and it appears from FIG. 1 that the distance between the bottom of the dishwasher and the shell can be minimized by the disclosed arrangement.

Figure 2:
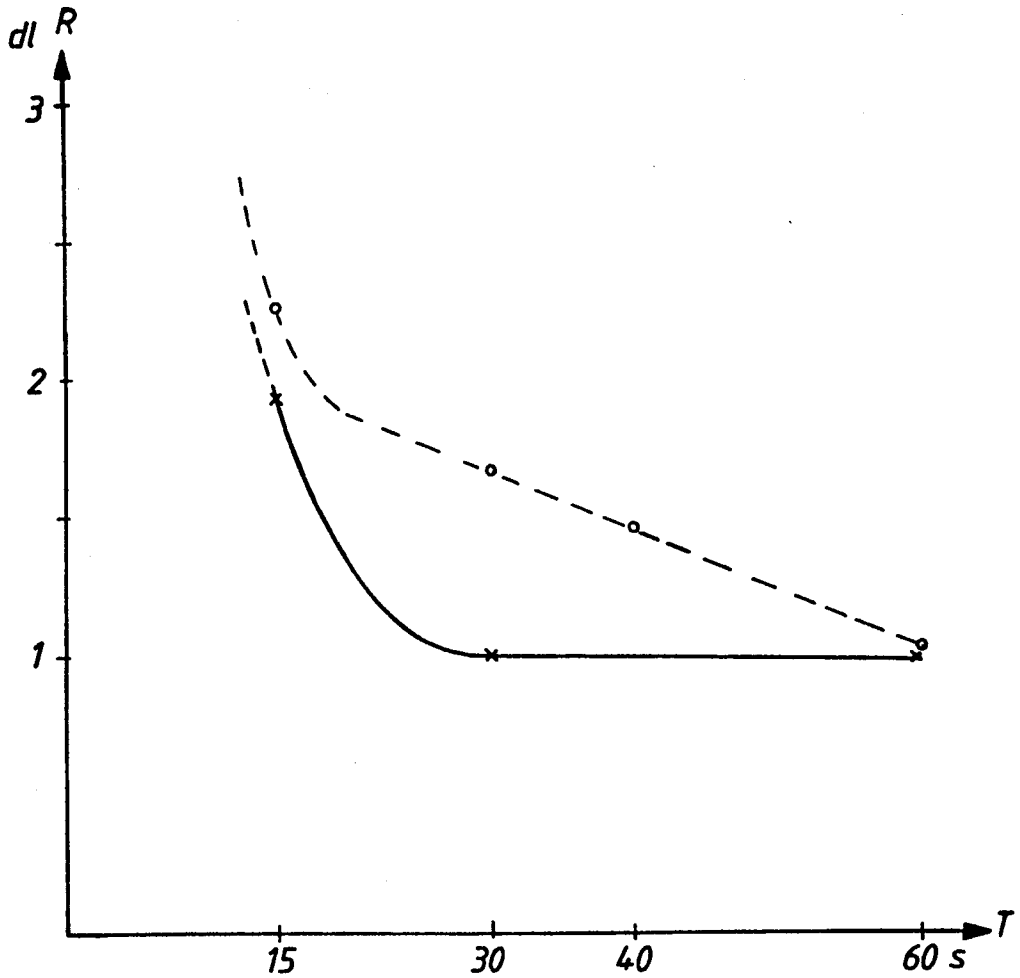
FIG. 2 is a graph showing the remaining water quantity as a function of the working time of the sewage pump.

The importance of the wall part 26 appears from the graphs in FIG. 2, where the dash-dotted line shows the remaining quantity R of water as a function of the working time T of the sewage pump with a pipe connection without any wall part, whereas, the solid line shows R and T with the pipe connection having said wall part From the graph, it clearly appears that it is possible to decrease the emptying time by means of the restriction wall from 60 to 30 seconds for a given remaining water quantity of 1 dl. This might depend on the fact that the pump, during the final period of the emptying procedure, when air begins to flow into the inlet 28, distributes the water step by step. The wall part 26 prevents the water which is successively thrown up into the pipe 17 from flowing back to the sump 11. This water will temporarily fill the pump housing and then be forced to the pump outlet.

Although the preferred embodiment of this invention has been shown and described, it should be understood that various modifications, replacements, and rearrangements of the parts may be resorted to without departing from the scope of the invention as disclosed and claimed herein.

WHAT IS CLAIMED IS:

1. A device for a dishwasher comprising a tub with a bottom which is provided with a sump (11) for collecting liquid circulating in the tub, the liquid during emptying of the dishwasher being distributed from the sump to the inlet side of a sewage pump (20) from which the liquid is discharged to a sewer, the bottom surface of the sump (11) being disposed no higher than the level of the pump housing (23) of the sewage pump, the inlet (21) of the sewage pump communicating via a pipe (17) with the sump, wherein the pipe (17) has a restriction (26). the pipe (17) comprising an outer part (18), the axial direction of which is mainly vertical. and an inner part (19). the axial direction of which is mainly horizontal. the restriction (26) being a wall extending mainly vertically upwards from the inner part (19).

2. A device according to claim 1, wherein the restriction (26) is placed at the location (27) between the outer part (18) and the inner part (19).

3. A device according to claim 1, wherein the area of the restriction (26) is less than half the area of the inner part (19) of the pipe (17).

4. A device according to claim 2, wherein the area of the restriction (26) is less than half the area of the inner part (19) of the pipe (17).

5. A device according to claim 1, wherein the outer part (18) of the pipe (17) has an inlet (28) which is placed 3–8 mm above the bottom surface of the sump.

6. A device according to claim 2, wherein the outer part (18) of the pipe (17) has an inlet (28) which is placed 3–8 mm above the bottom surface of the sump.

7. A device according to claim 3, wherein the outer part (18) of the pipe (18) has an inlet (28) which is placed 3–8 mm above the bottom surface of the sump.

8. A device according to claim 4, wherein the outer part (18) of the pipe (17) has an inlet (28) which is placed 3–8 mm above the bottom surface of the sump.

9. A device according to claim 1, wherein the pipe (17) is made of plastic.

10. A device according to claim 2, wherein the pipe (17) is made of plastic.

11. A device according to claim 3, wherein the pipe (17) is made of plastic.

12. A device according to claim 4, wherein the pipe (17) is made of plastic.

13. A device according to claim 5, wherein the pipe (17) is made of plastic.

14. A device according to claim 6, wherein the pipe (17) is made of plastic.

15. A device according to claim 7, wherein the pipe (17) is made of plastic.

16. A device according to claim 8, wherein the pipe (17) is made of plastic.

* * * * *